US007284334B1

(12) United States Patent
O'Brien

(10) Patent No.: US 7,284,334 B1
(45) Date of Patent: Oct. 23, 2007

(54) GEOMETRICAL LAYOUT SYSTEM FOR ESTABLISHING DIMENSIONS FROM A FIXED POINT TO SPECIFICALLY TARGETED ARCHITECTURAL, STRUCTURAL, MECHANICAL OR SITE LOCATIONS

(76) Inventor: Daniel Edward O'Brien, 721 SE. 15th St., Unit 4, Pompano Beach, FL (US) 33060

( * ) Notice: Subject to any disclaimer, the term of this patent is extended or adjusted under 35 U.S.C. 154(b) by 0 days.

(21) Appl. No.: 11/094,725

(22) Filed: Mar. 31, 2005

(51) Int. Cl.
*B43L 13/00* (2006.01)
*B43L 7/08* (2006.01)

(52) U.S. Cl. ..... 33/1 G; 33/563

(58) Field of Classification Search ..... 33/1 G, 33/1 R, 418, 424, 430, 562, 563, 1 BB, 1 C, 33/1 MP, 431
See application file for complete search history.

(56) References Cited

U.S. PATENT DOCUMENTS 1,679,931 A * 8/1928 Covell ..... 33/430
2,602,228 A * 7/1952 Webber ..... 33/1 R
3,432,927 A * 3/1969 Springer ..... 33/1 R
3,690,009 A * 9/1972 Henley, III ..... 33/1 MP
3,813,783 A * 6/1974 Price ..... 33/430
4,866,852 A * 9/1989 Plier ..... 33/431
4,879,812 A * 11/1989 Rabb ..... 33/1 MP
5,117,560 A * 6/1992 Nevins ..... 33/424
5,511,316 A * 4/1996 Fischer et al. ..... 33/562
6,594,914 B1 * 7/2003 Babcock ..... 33/563
2005/0246914 A1 * 11/2005 Perea ..... 33/562
2006/0026854 A1 * 2/2006 Babb ..... 33/563

* cited by examiner

*Primary Examiner*—G. Bradley Bennet
(74) *Attorney, Agent, or Firm*—Oltman, Flynn & Kubler

(57) ABSTRACT

A geometrical layout tool and method for locating a plurality of target points spaced apart over a particular area from a single reference point located within that area which is defined by the intersection of mutually perpendicular lines. A template placed over these lines has a central opening at the intersection and indicia at its periphery which register respectively with the lines. A center anchoring pin holds the template against movement, and a target line indicator is rotatably adjustable about the pin for alignment with a selected target point. A chalk line and tape measure or a laser may be mounted on the pin to make direction and distance determinations of the selected target point from the reference point.

9 Claims, 3 Drawing Sheets

GEOMETRICAL LAYOUT SYSTEM FOR ESTABLISHING DIMENSIONS FROM A FIXED POINT TO SPECIFICALLY TARGETED ARCHITECTURAL, STRUCTURAL, MECHANICAL OR SITE LOCATIONS

I have invented a tool and procedure to locate dimensional points from a single fixed point in order to place or locate such items as pipe sleeves for holes through floors, pipe hanger imbeds, support brackets, equipment, walls, structures or dimensional points relative to a range of placement or location needs.

DESCRIPTION AND USE

The geometrical lay-out system is comprised of a number of parts, one of which is called the target control template which has a center hole to nail or pin the template to a surface and includes vee shaped cut notches or markings around its perimeter to establish ninety (90°) degree and one hundred eighty (180°) degree angles from its axis, it also allows for up to 360 degree increments to be established from the template center.

To set the template in position, a predetermined or random single point within the range of targeted locations is chosen. From surveyed control lines, measurements are taken to the center of this point. Parallel lines from each control line can then be marked over this point, intersecting at the point's center and forming perpendicular lines.

The template center hole is then secured at the point of the intersecting lines and the perimeter vee shaped notches or markings are aligned with the perpendicular lines.

After the template is positioned, a chalked string line is pulled from the center hole of the template to the center of the targeted locations. In each case the chalk line is snapped, leaving a line imprint on the template face. A straight edge called the "target line indicator" is then placed over each chalk line on the template and marked with indelible ink through a cut out window on the line indicator. (NOTE: This procedure can also be accomplished by placing a laser over the center of the control template and line indicator and aligning the laser light with the target locations and transcribing the light line through the cut out window on the line indicator onto the face of the control template.)

A tape measure is then pulled from the center of the control template to the center of each targeted location. The dimension to each location, along with a target item description is then written on the template face on each specific target indicator line.

A north or directional arrow and system labeling is also placed on the template face in a conspicuous area, making the control template ready for removal and repetitious use. (NOTE: Digital laser increments in place of a tape measure may be used to establish dimensions to the individual target location.) (NOTE: In place of physically marking and labeling the control template, a dimensional, computerized printout derived from project blueprints may be attached to the template or be printed on material suitable to be used as the template.)

When the control template is moved to the next typical area to be laid out, the template positioning instructions are repeated.

Once the control template is placed in a new typical area, a chalk line is pulled from the template center over each premarked line on the template to the target locations and snapped. (NOTE: A laser may be used in place of a chalk line by sighting the light line over the premarked lines on the control template to the target locations.)

A tape measure is then pulled from the control template center in correlation to the chalk or laser lines to the specific recorded dimension listed on the template and the target location marked on the appropriate line. (NOTE: Digital laser increments in place of a tape measure may be used to establish dimensions to the individual target locations and marked on the appropriate light line.)

After the target location is marked, a template with perpendicular line cut-outs called the "target locator" is placed with the intersecting point of the lines centered over the target location mark. Perpendicular lines can then be transferred by marking through the locator cut-outs to further assist in positioning or anchoring the specific target.

Currently in the construction industry, the conventional layout process used to locate specific dimensional points to determine the placement of an object or to create a starting point for laying out an area is being done by pulling two parallel measurements from each of two perpendicular surveyed control lines. Some of the disadvantages of the conventional layout process are:

- Four measurements are needed to establish each location.
- The surveyed control lines are normally remote from the areas to be located, requiring long dimensional pulls to each location.
- The surveyed control lines are seldom central to the areas to be located, requiring overlapping dimensional pulls to each location.
- Two persons are needed to measure each location.

There are home made devices utilized to expand the conventional layout process, so as to incorporate more than one location from one established location. Examples include story poles, jigs, pattern cut outs or grid lines. However they are bulky, cumbersome, labor intensive, conditionally difficult to use and have limited range.

Geometrical Layout System

The alternative to the conventional layout process is the Geometrical Layout System, consisting of a target control template, target line indicator, target locator, accessories, optional laser and optional computerized drawings. The advantages of the Geometrical Layout System are:

- Only one conventional layout process is needed to place the control template. All other locations can then be established from a central point utilizing only one measurement to each target location, in place of the conventional four dimensions.
- The control template location can be remote from the surveyed control lines, placing it closer to the areas to be located.
- The control template location can be centrally placed in relation to the areas to be located, avoiding overlapping measurements.
- All of the individual locations are pulled from the center of the control template at independent degrees, allowing for a 360 degree range.
- One person can align and pull each target location measurement by attaching to the center of the control template with a provided accessory pin and tape adaptor or pin and laser adaptor.

Manufacturing Methods

The physical component parts are made from durable, light weight, weather resistant materials and may be manufactured by a variety of methods including molding, pressing or cutting.

The physical shape, width or thickness of the target control template, target line indicator and target locator may vary to accommodate logistical conditions, while maintaining strict geometrical quality control.

Locations and geometrical information may be transposed on the target control template by a variety of methods including manual writing, etching, scoring, stamping, molding, attaching an independent transcript or automatic printing directly on suitable template material.

Figure 1:
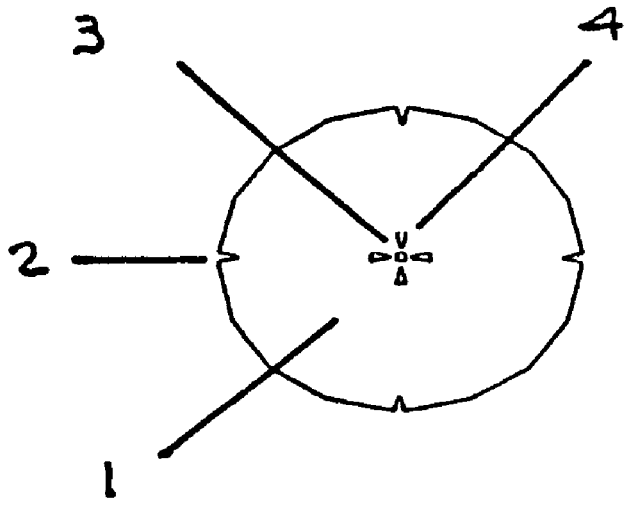
FIG. 1 shows a top view of a target control template 1, vee shape notch for alignment 2, center hole for securement 3, vee shape cut out for sight placement 4.
Figure 2:
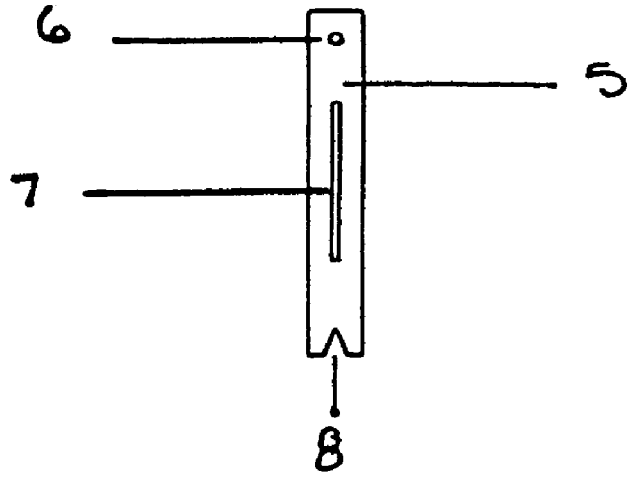
FIG. 2 shows a top view of a target line indicator 5, center hole for securement 6, cut out for marking directional target line 7, vee shape notch for alignment 8.
Figure 3:
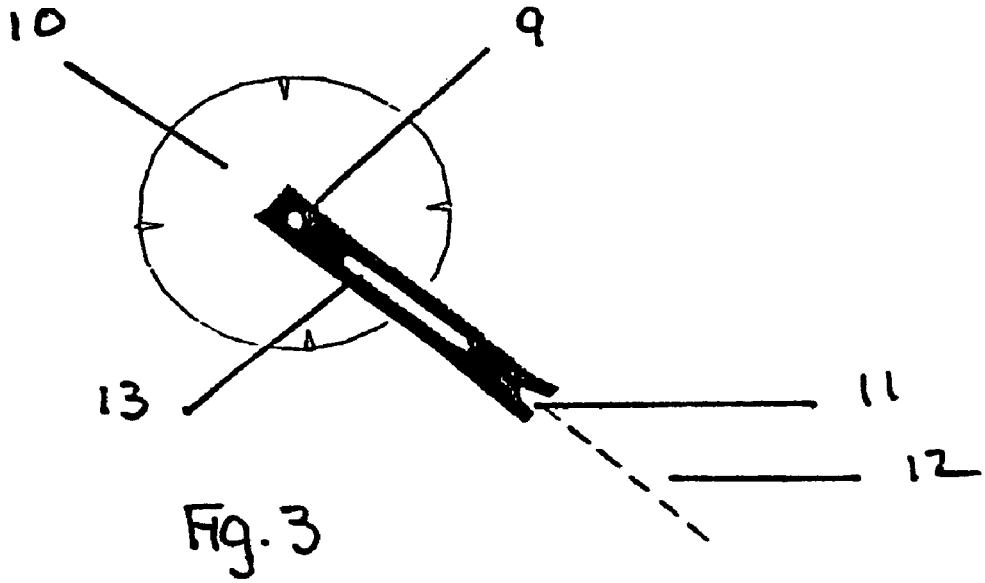
FIG. 3 shows the center hole of a line indicator 9, placed over the center hole of a control template 10, with the vee shape notch 11, aligned with a target location line 12, to position the cut out window 13, for marking a matching target indicator line on the control template 10.
Figure 4:
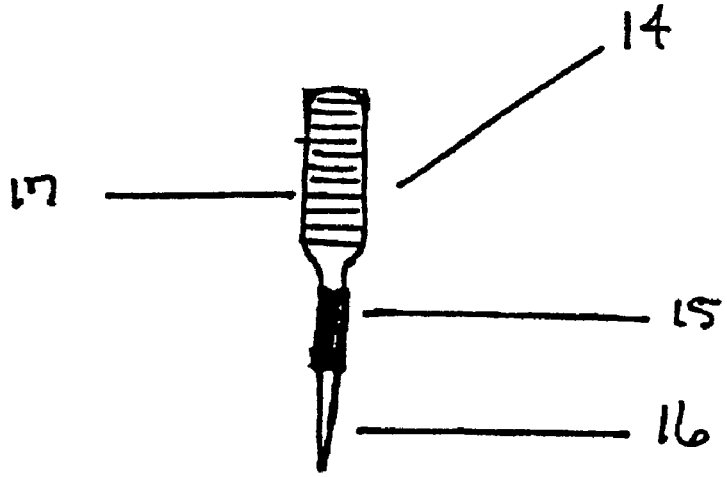
FIG. 4 shows a side view of a center anchoring adaptor pin 14, shaft area for tape measure or chalk line attachment 15, tapered shaft for center hole anchoring 16, threaded shaft for laser attachment 17.
Figure 5:
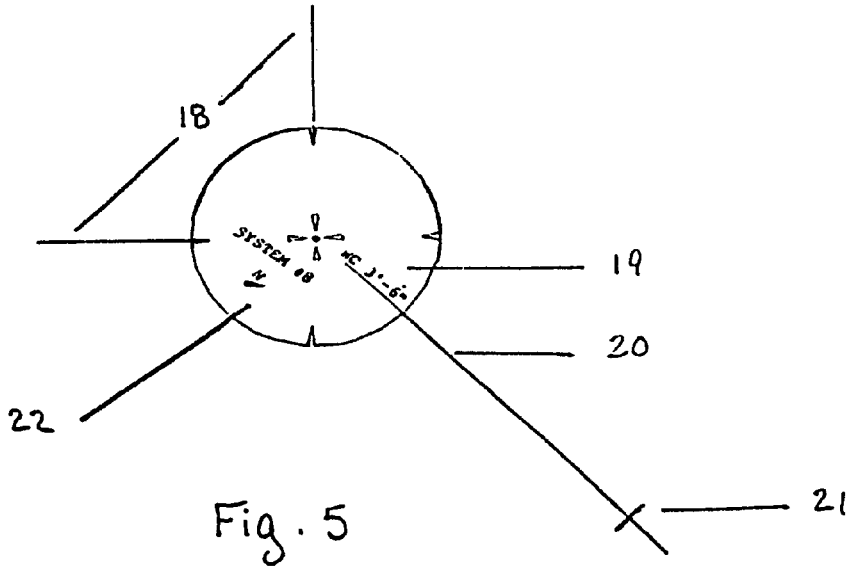
FIG. 5 shows two of the vee shaped notches on the control template aligned with the perpendicular positioning lines 18, labeling of target description and distance 19, chalk or laser target line extended 20, target location marked on chalk or laser line 21, north arrow and system label 22.
Figure 6:
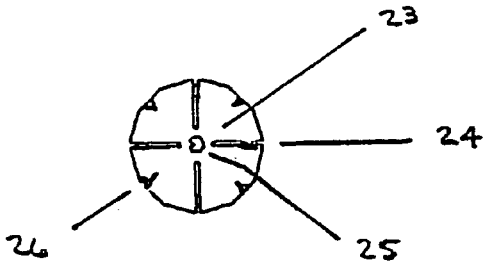
FIG. 6 shows the target locator 23, cut out slots for marking perpendicular lines relative to the target center 24, cut out window with a vee shaped sight to place the locator on the target center 25, vee shape notches for positioning or establishing 45 degrees from target locator lines 26.
Figure 7:
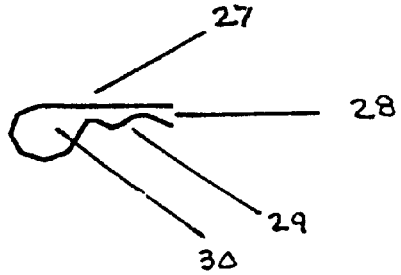
FIG. 7 shows the tape measure adaptor 27, opening to insert tape measure end clip 28, hairpin bends to lock into key way slot of tape measure end clip 29, opening for center adaptor anchoring pin 30.

I claim:

1. A geometrical layout method for locating a plurality of target points spaced apart over a particular first area from a single reference point located within the first area, comprising the steps of:

creating intersecting lines which intersect at the reference point;

placing over the intersecting lines a target control template having a periphery with indicia thereon at set intervals which are in overlying registration respectively with the intersecting lines, and a central opening directly over the intersection of said intersecting lines;

inserting a center anchoring pin down into the underlying central opening in the template to hold the template against movement with respect to the intersecting lines;

turning the target line indictor about the center anchoring pin to align the window opening with a selected one of the target points;

using the center anchoring pin as the locus from which to determine the direction and distance of the selected target point from the reference point and making radial direction marks on the template for each target point;

placing the template on a second area parallel with and spaced apart from the first area such that the location of the central opening in the template on the second area registers with the location of the central opening in the template on the first area and using the direction marks to determine the directions of target points on the second area corresponding to the directions of the target points on the first area;

and measuring the distance of each target point on the second area using distance determinations for corresponding target points on the first area and marking the location of the corresponding and registering target points on the second area.

2. A method according to claim 1 wherein the center anchoring pin has a segment for holding a chalk line to make the direction determination and a tape measure to make the distance determination along the window opening in the target line indicator.

3. A method according to claim 1 wherein the center anchoring pin has a segment for holding a laser to make the direction and distance determinations radially of the template from the central opening therein along the window opening in the target line indicator.

4. A method according to claim 1 wherein the center anchoring pin has a segment for holding a chalk line to make the direction determination and a tape measure to make the distance determination radially of the template from the central opening therein along the window opening in the target line indicator, and a threaded segment for holding a laser to make the direction and distance determination radially of the template from the central opening therein along the window opening.

5. A method according to claim 1 wherein:

the indicia on the template are V-shaped notches in its periphery;

the template has radially extending V-shaped cut-outs therein spaced around the central opening at set intervals in radial alignment respectively with the notches in the periphery of the template;

and the target line indicator has a V-shaped edge notch located beyond the opposite end of the window opening from the hole and aligned with the window opening and the hole.

6. A method according to claim 4 wherein the center anchoring pin has a segment for holding a chalk line to make the direction determination and a tape measure to make the distance determination radially of the template from the central opening therein along the window opening in the target line indicator.

7. A method according to claim 4 wherein the center anchoring pin has a segment for holding a laser to make the direction and distance determinations radially of the template from the central opening therein along the window opening in the target line indicator.

8. A method according to claim 4 wherein the center anchoring pin has a segment for holding a chalk line to make the direction determination and a tape measure to make the distance determination radially of the template from the central opening therein along the window opening in the target line indicator, and a threaded segment for holding a laser to make the direction and distance determinations radially of the template from the central opening therein along the window opening.

9. A method according to claim 1, comprising the additional steps of:

making target line marks on the template which are each in radial alignment between the central opening in the template and one of the target points;

and measuring and recording the distance from the central opening to each target point and recording the distance adjacent to the corresponding target line mark.

* * * * *